US007743470B2

(12) United States Patent
Graf

(10) Patent No.: US 7,743,470 B2
(45) Date of Patent: Jun. 29, 2010

(54) METHOD AND DEVICE FOR MANUFACTURING SAWTOOTH CARD CLOTHING AND ALL-STEEL CARD CLOTHING AS WELL AS SAWTOOTH WIRE

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 977 days.

(21) Appl. No.: 11/444,985

(22) Filed: Jun. 1, 2006

(65) Prior Publication Data

US 2007/0028423 A1 Feb. 8, 2007

(30) Foreign Application Priority Data

Jun. 3, 2005 (DE) ..... 10 2005 025 627

(51) Int. Cl.
*D01G 15/84* (2006.01)
*B21F 45/00* (2006.01)

(52) U.S. Cl. ..... 19/114; 140/92.4

(58) Field of Classification Search ..... 19/110, 19/111, 113, 102, 103, 114; 76/101.1, 112; 140/92.4; 204/206, 210
See application file for complete search history.

(56) References Cited

U.S. PATENT DOCUMENTS 4,771,659 A * 9/1988 Schmolke ..... 76/1
4,937,919 A * 7/1990 Graf ..... 19/114
5,452,627 A * 9/1995 Graf et al. ..... 76/101.1
5,581,848 A * 12/1996 Egerer ..... 19/114
6,874,203 B2 * 4/2005 Bauersachs ..... 19/114

FOREIGN PATENT DOCUMENTS

| | | |
|---|---|---|
| BE | 526226 | 7/1956 |
| DE | 1086259 | 8/1960 |
| DE | 2330303 | 1/1975 |
| JP | 60075526 | 4/1985 |

* cited by examiner

*Primary Examiner*—Tejash Patel
(74) *Attorney, Agent, or Firm*—Friedrich Kueffner

(57) ABSTRACT

In a method for manufacturing sawtooth card clothings and all-steel card clothings for processing textile fibers in a carding process, a sawtooth wire is produced by generating teeth on a wire blank sequentially behind one another in a longitudinal direction of the wire blank, wherein the teeth extend transversely to the longitudinal direction away from a base area. The sawtooth wire is subjected at least in the area of the teeth to a hardening process under exclusion of oxygen in the area of the sawtooth wire. A device for performing the method has a heating chamber having an inlet opening and an outlet opening for the sawtooth wire passing through the heating chamber. An arrangement for generating an inert gas atmosphere in the area of the sawtooth wire passing through the heating chamber is provided.

21 Claims, 1 Drawing Sheet

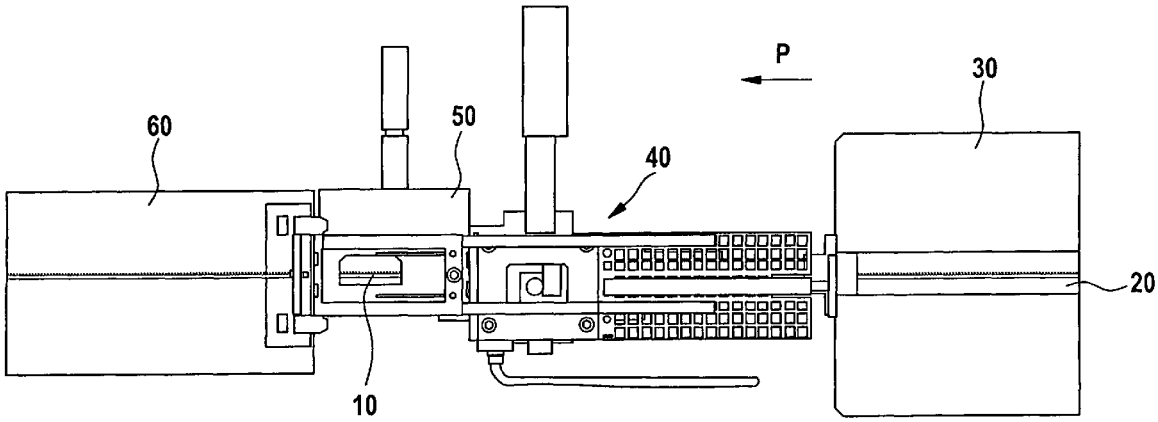
P
30
60
50
40
20
10

METHOD AND DEVICE FOR MANUFACTURING SAWTOOTH CARD CLOTHING AND ALL-STEEL CARD CLOTHING AS WELL AS SAWTOOTH WIRE

BACKGROUND OF THE INVENTION

1. Field of the Invention

The invention relates to a method for manufacturing sawtooth card clothing and all-steel card clothing for processing textile fibers, in particular, in connection with a carding process. According to the method, a wire blank is provided with teeth sequentially arranged in a longitudinal direction of the wire and extending, starting at the base area, transversely to the longitudinal direction and the sawtooth wire generated accordingly is subjected, at least in the area of the teeth, to a hardening process. The invention also relates to a device for performing such a method as well as to sawtooth wire manufactured by such a method.

2. Description of the Related Art

Sawtooth wires that are manufactured by methods of the aforementioned kind from unalloyed or alloyed steels are used, for example, in cards for treating textile fibers. For this purpose, the sawtooth wires can be mounted, for example, in a coil shape on a circular cylinder support (tambour) of the card.

In modern cards, sawtooth wire having a length of several kilometers is required for producing the sawtooth card clothing or all-steel (metal) card clothing for the tambour of a card. For processing textile fibers, the tambour of the card with the wire card clothing disposed thereon is rotated about its cylinder axis so that the card clothing can pass through and clean fiber material supplied to the tambour; the tambour card clothing cooperates with stationary or oppositely driven flat cards each provided with an appropriate flat card clothing. In this type of fiber processing, for obtaining a satisfactory carding result and for preventing damage to the card it must be ensured that the sawtooth wires are mounted with high precision in such a way on the circular cylinder support that no changes of the radial spacing of the sawtooth wire tips from the axis of rotation of the tambour will result that would negatively affect the carding result or the operating reliability; even local imprecisions resulting during mounting of the wire on the tambour can cause damage of the thus formed sawtooth card clothing and all-steel card clothing that may require a complete exchange.

This is very cost-intensive in modern high-performance cards with regard to the downtimes of the machine and the required materials. Moreover, in the context of ensuring a satisfactory carding quality a random axial displacement of sequentially arranged windings must be prevented also. Moreover, for obtaining a satisfactory service life of a card, it must be ensured that an excessive wear of the sawtooth wires is prevented. For this purpose, the teeth of the sawtooth wires to be mounted on the tambour are subjected to a hardening process. For example, they can be heated by means of an open flame to their austenization temperature, respectively, and can be subsequently quenched.

In particular when heating the wire a scale or oxide layer of varying thickness can form on the wire. Such a layer presents a particular problem in regard to the required precision of the card clothing mounted in a coil shape on the support. The sawtooth wire is mounted on the rotating support by means of a wire mounting device. For ensuring the required wire mounting precision, the wire must pass through narrow guides. During this process, as a result of bending and friction of the wire in the guides, scale particles can chip off the wire surface and deposit in the mounting device and especially in the guides. Such contamination of the guides can greatly affect the wire mounting quality and the speed at which wire mounting is carried out. Moreover, because of the scale particles chipping off, it can be required to frequently interrupt the wire mounting process in order to clean the wire mounting device and, in particular, its guides. If these cleaning interruptions are not performed timely, the pulling forces acting on the wire that increase because of increasing contamination of the guides can rise to such an extent that the wire will break In regard to these problems it has been proposed already to remove after the hardening process the scale or oxide layers produced during hardening. For this purpose, abrasive methods are known, for example, in which the wires after the hardening process are brushed with rotating metal brushes so that the adhering scale is removed as much as possible. In another method, the wire is ground by profiled grinding wheels for removing the scale layer. Finally, chemical methods are also known for removing the scale layer chemically.

However, the methods for removing the scale layer that have been proposed in view of the above mentioned problems have the disadvantage that as a result of the mechanical or chemical material removal the wire itself is also damaged to a greater or lesser degree. Moreover, the removal of the scale layer done to avoid the problems in regard to mounting the wire can also lead to the flanks and tips of the teeth of the sawtooth wire to become rounded so that the teeth lose some of the desired sharpness.

SUMMARY OF THE INVENTION

It is an object of the present invention, in view of the aforementioned problems, to provide a method for manufacturing sawtooth and all-steel card clothings for treating textile fibers with which method the card clothings can be produced quickly and reliably without impairing the quality of the card clothings.

In accordance with the present invention, this is achieved in that the hardening process is carried out under exclusion of oxygen in the area of the sawtooth wire wherein the sawtooth wire preferably passes through a heating chamber.

By means of the method according to the invention, the scale or oxide layer is avoided from the start because of exclusion of oxygen during the hardening process so that the contamination problems leading to impairing and slowing of the wire mounting process when employing wires produced according to the known methods do not occur at all with wires according to the invention; therefore, an impairment of the sawtooth wire quality as a result of the otherwise required removal of the scale or oxide layer is not to be expected.

Moreover, with the sawtooth wire card clothings and all-steel card clothings according to the present invention, an improved quality of the carded fibers can be ensured because the card clothings produced in accordance with the prior art, despite the described measures, in many cases still contain scale particles that, during the course of fiber treatment, become detached from the card clothing and can contaminate the textile fibers. In the case of the card clothings manufactured according to the conventional methods this leads to an impairment of the carding results and a reduction of the service life of the card clothings because the detached scale particles also cause additional wear of the card clothings. These problems are solved in principle by the method according to the invention because there is no scale formation at all on the sawtooth wire surface.

In the method according to the present invention, the teeth of the sawtooth wire can be heated during the course of the hardening process, as in the prior art methods, to an austenization temperature of preferably approximately 500° C. to 1,200° C., in particular, approximately 800° C.-1,000° C., optionally after preheating to, for example, 500° C. to 800° C., and subsequently can be cooled quickly. The subsequent cooling (quenching) process of the sawtooth wire is carried out preferably also under exclusion of oxygen or other oxidizing gases. Expediently, for the cooling step a quenching bath is used that can be operated with water, an emulsion of oil and water, or oil; the sawtooth wire, in continuous operation, is first heated and then cooled in the quenching bath.

Cooling is realized expediently in an oil bath in order to avoid the occurrence of stress cracks in the wire. In an especially preferred embodiment of the invention, the sawtooth wires can be annealed, i.e, subjected to an additional heat treatment, for reducing brittleness, still present despite the use of an oil bath for quenching, or for increasing the tenacity. This additional heat treatment process is expediently carried out also under exclusion of oxygen or other oxidizing gases in the area of the teeth to be hardened.

In the method according to the invention heating of the sawtooth wires to the austenization temperature can be realized, while securing continuous operation within the context of a continuous production process, in that at least the teeth of the sawtooth wire pass through a flame at least during heating in the context of the hardening process. In this connection, the flame, for ensuring the exclusion of oxygen in the area of the sawtooth wire in accordance with the present invention, is generated in an unreactive inert gas atmosphere, for example, a nitrogen atmosphere. The desired oxygen exclusion can be ensured in this connection in that for generating the flame a combustion gas and an oxidizing medium, for example, oxygen, are introduced into the heating chamber in such a way that the oxidation medium never comes into contact with the teeth to be hardened and is preferably completely reacted during the combustion process for producing the flame. When performing the method according to the invention, the flame used for heating the wire is therefore expediently generated without excess oxygen.

Undesirable contact of the teeth with oxygen from the air can be excluded substantially when the heating chamber is subjected to a flow of the inert gas wherein expediently an inert gas overpressure is maintained in the heating chamber.

The sawtooth wires produced with the method according to the invention must be provided in the area of their teeth or tooth tips with a particularly great hardness in order to have satisfactory service life. On the other hand, these sawtooth wires must have in their base area still such a deformability that they can be mounted in a coil shape on the circular cylinder support. In this connection, the microstructure of the sawtooth wires at the tooth tip is usually comprised of martensite and in the base area of ferrite with embedded (globular) cementite. For achieving the desired structure in the base area, when performing the method according to the invention, the sawtooth wires are expediently (spheroidize) annealed before the hardening process at least within the base area. The flame that is utilized in the course of the hardening process is expediently adjusted for securing the desired microstructure in the base area in such a way that heating is effected only in the area of the sawteeth and in particular in the area of the tooth tips.

The wire blank used in connection with the method of the present invention is provided expediently in the form of cold-rolled profiled sections in order to obtain the desired cross-sectional shape of the wires.

When performing the method according to the invention, preferably two different gas systems are utilized. One system for controlled and regulated introduction of the inert gas and a second system for introduction of a predetermined mixture of oxygen and combustion gas into the burner or the heating chamber are provided. In this connection, the inert gas, depending on the operating state and the burner position (start-up, stop, etc.) is controlled with regard to quantity and pressure in the heating chamber. The mixture of combustion gas and oxidation medium and the burner geometry are selected such that the teeth when passing the flame have no contact with unburnt oxygen so that no scale is formed. Moreover, the introduction of the inert gas and the thus resulting flow conditions contribute to the prevention of the contact between oxidation medium and teeth.

The all-steel card clothing wires produced in accordance with the present invention have the following advantages in comparison to wires produced by conventional methods.

The card clothing wires that are produced in accordance with the present invention are free of any scale so that no scale residues can be deposited in the guides of the wire mounting devices. In the end, this means that by means of the wires produced in accordance with the inventive method a significantly higher wire mounting speed in comparison to all-steel card clothing wires produced according to conventional methods can be achieved. Moreover, interruptions of the wire mounting process for cleaning the guides and the wire mounting device are not required when using wire produced in accordance with the method of the present invention. Moreover, jamming and breaking of the wire in the guides is securely prevented.

A further advantage of card clothings produced with the method according to the invention is that when using card clothings produced with wire free of scale, contamination of the textile fibers by means of scale residues is completely prevented. In this connection, it should be noted that the described disadvantage of contamination of textile fibers by scale residues can be substantially prevented by use of brushed wires or wires ground by grinding wheels. However, the wires that are produced by these known methods have the great disadvantage that the grinding or polishing also rounds the edges and tips of the teeth in an undesirable way so that the card clothing wire loses to a significant degree the desired edge sharpness required for its utilization; therefore, its carding performance is significantly reduced in comparison to wires that are not abrasively treated. The same disadvantages hold true also in connection with chemically treated wires.

As can be taken from the above explanations of the method according to the invention, a device for performing the method according to the present invention comprises a hardening chamber with an inlet opening and an outlet opening for a sawtooth wire passing through the chamber and an arrangement for generating an inert gas atmosphere in the area of the teeth of the sawtooth wire passing through the chamber.

For obtaining the heat required for the hardening process of the teeth, the device can have a burner arrangement for generating a flame in the area of the teeth of the sawtooth wire passing through the chamber. For generating a mixture that ensures exclusion of oxygen in the area of the teeth as much as possible, the burner arrangement can have a mixing device with which a combustion gas and an oxidation medium, for example, oxygen, are mixable in accordance with a predetermined ratio before the mixture produced in this way is reacted or combusted for obtaining the flame.

In addition, the chamber can have a nozzle arrangement for introducing the inert gas. By means of this nozzle arrangement the inert gas is expediently introduced in such a way that an inert gas overpressure results in the chamber; by means of the inert gas conduit it is additionally ensured that the oxidation medium or the oxygen will not come into contact with the teeth of the sawtooth wire.

The heating chamber of a device according to the present invention can have downstream thereof an arrangement for cooling the heated teeth. This arrangement comprises expediently an oil bath through which the sawtooth wire passes under exclusion of oxygen.

Moreover, in accordance with the present invention, an annealing device for annealing the sawtooth wires can be arranged in the passing direction of the wire upstream of the chamber.

In the context of the method according to the invention, the wire blank is usually provided with the teeth by a stamping or die-cutting process.

A sawtooth wire produced in accordance with the method of the present invention is essentially characterized in that it has hardened teeth, having neither scale residues nor rounded edges produced by a mechanical grinding process or a chemical process.

Above, the method according to the invention has been explained in connection with the manufacture of card clothings for the tambour of a carding device. In addition, the method according to the invention can also be used for manufacturing card clothings for licker-in rollers etc.

BRIEF DESCRIPTION OF THE DRAWING

In the following, the invention will be explained with reference to the drawing, reference being had expressly to illustrated features not explained in detail in the description but important for the invention.

The only FIGURE shows a schematic illustration of a device suitable for performing the method according to the invention.

DESCRIPTION OF THE PREFERRED EMBODIMENTS

The device illustrated in the drawing comprises a tubular chamber referenced at 20 into which the sawtooth wire 10 is conveyed in the direction indicated by arrow P. The wire passes first through a preheating device 30 in which it is preheated inductively to a temperature between 500° C. to 800° C. After leaving the preheating device, an inert gas is supplied into the tubular chamber 20 by means of a corresponding inert gas introduction device 40. Downstream of the inert gas introduction device 40, the wire 10 that is now conveyed in an inert gas atmosphere is heated in the area of the teeth to the austenization temperature by means of the burner device 50 under the exclusion of oxygen. For this purpose, in the area of the teeth within the combustion chamber 50 a flame is generated. The appropriate burner arrangement has a mixing device with which the combustion gas and oxidation medium are introduced into the burner chamber 50 in such a way that the oxidation medium is reacted or burned completely by combustion and does not come into contact with the teeth of the sawtooth wire.

Downstream of the burner chamber 50, the sawtooth wire 10 passes through a quenching device 60.

While specific embodiments of the invention have been shown and described in detail to illustrate the inventive principles, it will be understood that the invention may be embodied otherwise without departing from such principles.

What is claimed is:

1. A method for manufacturing sawtooth card clothing and all-steel card clothing for processing textile fibers in a carding process; the method comprising the steps of:

producing a sawtooth wire by generating teeth on a wire blank sequentially behind one another in a longitudinal direction of the wire blank, wherein the teeth each extend transversely to the longitudinal direction away from a base area;

subjecting the sawtooth wire at least in the area of the teeth to a hardening process under exclusion of oxygen in the area of the sawtooth wire.

2. The method according to claim 1, wherein in the hardening process the sawtooth wire passes through a heating chamber.

3. The method according to claim 1, wherein the sawtooth wire during the hardening process is heated to an austenization temperature of approximately 500° C. to 1,200° C. and is subsequently quickly cooled.

4. The method according to claim 3, wherein the austenization temperature is approximately 800° C. to 1,000° C.

5. The method according to claim 2, further comprising the step of preheating before subjecting the sawtooth wire to the hardening process.

6. The method according to claim 2, wherein the sawtooth wire, after cooling, is annealed for reducing brittleness or increasing tenacity.

7. The method according to claim 6, wherein annealing is carried out under exclusion of oxygen.

8. The method according to claim 2, wherein at least the teeth of the sawtooth wire at least during heating in the hardening process are passed through a flame.

9. The method according to claim 8, wherein the flame is generated in an unreactive inert gas atmosphere.

10. The method according to claim 9, wherein the inert gas atmosphere is a nitrogen atmosphere.

11. The method according to claim 8, wherein for generating the flame a combustion gas and an oxidation medium are introduced in such a way into the heating chamber that the oxidation medium does not contact the teeth to be hardened.

12. The method according to claim 11, wherein the oxidation medium is completely reacted in a combustion process for generating the flame.

13. The method according to claim 11, wherein the oxidation medium is oxygen.

14. The method according to claim 2, wherein an inert gas flows through the heating chamber.

15. The method according to claim 2, wherein the heating chamber is filled with inert gas at overpressure for preventing penetration of ambient oxygen.

16. The method according to claim 1, further comprising the step of annealing the sawtooth wire at least in a base area before performing the hardening process.

17. A device for performing the method according to claim 1, the device comprising:

a heating chamber having an inlet opening and an outlet opening for a sawtooth wire passing through the heating chamber;

an arrangement for generating an inert gas atmosphere in the area of the sawtooth wire passing through the heating chamber.

18. The device according to claim 17, wherein the heating chamber has a burner arrangement for generating a flame in the area of the teeth of the sawtooth wire passing through the heating chamber.

19. The device according to claim 18, wherein the burner arrangement comprises a mixing device in which a combustion gas and an oxidation medium are mixable to a mixture according to a predetermined ratio before the mixture is reacted in the heating chamber for generating the flame.

20. The device according to claim 17, further comprising a nozzle arrangement for introducing the inert gas into the heating chamber.

21. A sawtooth wire produced according to the method of claim 1.

* * * * *